US007721824B2

(12) United States Patent
Singh et al.

(10) Patent No.: US 7,721,824 B2
(45) **Date of Patent: *May 25, 2010**

(54) MULTIPLE INSERTS OF DIFFERENT GEOMETRY IN A SINGLE ROW OF A BIT

(75) Inventors: Amardeep Singh, Houston, TX (US); Scott D. McDonough, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 145 days.

This patent is subject to a terminal disclaimer.

(21) Appl. No.: 11/969,713

(22) Filed: Jan. 4, 2008

(65) Prior Publication Data

US 2008/0201115 A1 Aug. 21, 2008

Related U.S. Application Data

(63) Continuation-in-part of application No. 11/692,013, filed on Mar. 27, 2007, now Pat. No. 7,377,332, which is a continuation of application No. 10/886,474, filed on Jul. 7, 2004, now Pat. No. 7,195,078.

(51) Int. Cl.
*E21B 10/20* (2006.01)

(52) U.S. Cl. ..... 175/57; 175/431; 76/108.2

(58) Field of Classification Search ..... 175/57, 175/426, 431; 76/108.2
See application file for complete search history.

(56) References Cited

U.S. PATENT DOCUMENTS 2,468,662 A 4/1949 Glendening et al.
2,533,259 A 12/1950 Woods et al.
4,187,922 A 2/1980 Phelps
4,316,515 A 2/1982 Pessier
4,441,566 A 4/1984 Pessier
4,940,099 A 7/1990 Deane
5,224,560 A 7/1993 Fernandez
5,285,859 A 2/1994 Tibbitts (Continued)

FOREIGN PATENT DOCUMENTS

GB 2 403 313 A 12/2004

(Continued)

OTHER PUBLICATIONS

Combined Search and Examination Report issued in related UK Application No. GB0801835.0, dated Apr. 11, 2008, (5 pages).

(Continued)

*Primary Examiner*—William P Neuder

(57) ABSTRACT

A method for designing a roller cone drill bit having a plurality of cutting elements in a row. The method includes defining a pitch pattern for the plurality of cutting elements such that a first group of adjacent cutting elements are arranged in a first pitch and a second group of adjacent cutting elements are arranged in a second pitch in the row, wherein the first group of adjacent cutting elements have a different extension length than the second group of adjacent cutting elements, evaluating the pitch pattern of the plurality of cutting elements in the row, and modifying at least one of the plurality of cutting elements based on the evaluating of the pitch pattern of the plurality of cutting elements.

24 Claims, 12 Drawing Sheets

U.S. PATENT DOCUMENTS

| | | | | |
|---|---|---|---|---|
| 5,839,526 | A | 11/1998 | Cisneros | |
| 6,209,668 | B1 | 4/2001 | Pessier | |
| 6,401,839 | B1 | 6/2002 | Chen | |
| 6,443,246 | B1 | 9/2002 | Pessier et al. | |
| 6,516,293 | B1 | 2/2003 | Huang et al. | |
| 7,195,078 | B2 * | 3/2007 | Singh et al. | 175/40 |
| 7,377,332 | B2 * | 5/2008 | Singh et al. | 175/40 |
| 7,441,612 | B2 * | 10/2008 | Durairajan et al. | 175/431 |
| 2003/0192721 | A1 | 10/2003 | Singh et al. | |
| 2003/0196835 | A1 | 10/2003 | Singh et al. | |
| 2004/0035609 | A1 | 2/2004 | Overstreet | |
| 2004/0118609 | A1 | 6/2004 | Dennis | |
| 2006/0180356 | A1 * | 8/2006 | Durairajan et al. | 175/431 |
| 2006/0278436 | A1 * | 12/2006 | Dykstra et al. | 175/57 |

FOREIGN PATENT DOCUMENTS

| | | | |
|---|---|---|---|
| SU | 1263799 | A1 | 10/1986 |
| SU | 1441051 | A2 | 11/1988 |

OTHER PUBLICATIONS

Combined Search and Examination Report issued in related UK Application No. GB0513765.8, dated Sep. 6, 2005, (7 pages).

Examination Report issued in related UK Application No. GB0513765.8, dated Aug. 2, 2006, (3 pages).

* cited by examiner

MULTIPLE INSERTS OF DIFFERENT GEOMETRY IN A SINGLE ROW OF A BIT

CROSS-REFERENCE TO RELATED APPLICATIONS

The present application is a continuation in part of U.S. patent application Ser. No. 11/692,013, entitled "Multiple Inserts of Different Geometry in a Single Row of a Bit" filed Mar. 27, 2007 by Amardeep Singh et al, which is a continuation of U.S. Pat. No. 7,195,078, filed on Jul. 7, 2004. Both references are hereby incorporated by reference herein.

BACKGROUND OF THE DISCLOSURE

1. Field of the Disclosure

The present disclosure relates generally to drill bits for drilling boreholes in subsurface formations. More particularly, the present disclosure relates to designing drill bits, evaluating cutting structures, and designing cutting elements in view of the evaluating of the cutting structure.

2. Background Art

FIG. 1 shows one example of a conventional drilling system used in the oil and gas industry for drilling wells in earth formations. The drilling system includes a drilling rig (10) used to turn a drill string (12), which extends downward into a well bore (14). Connected to the end of the drill string (12) is a drill bit (20). The drill bit (20) is designed to break up and gouge earth formations (16) when rotated on the formations (16) tinder an applied force. Formation (16) broken up by the drill bit (20) during drilling is removed from the well bore (14) by drilling fluid typically pumped through the drill string (12) and drill bit (20) and up the annulus between the drill string (12) and the well bore (14).

One example of a conventional drill bit is shown in FIG. 2. This type of drill bit is typically referred to as a roller cone drill bit. A roller cone drill bit (20) includes a bit body (22) having a threaded section (24) at its upper end for securing to the drill string (12 in FIG. 1) and a plurality of legs (25) extending downwardly at its lower end. A frusto-conical rolling cone cutter (hereafter referred to as roller cone 26) is rotatably mounted on each leg (25) by a bearing shaft pin, which extends downwardly and inwardly from each leg (25). Each of the roller cones (26) has a cutting structure comprising a plurality of cutting elements (28) arranged on the conical surface of the cones (26). The cutting elements (28) project from the cone body and act to break up earth formations at the bottom of the borehole when the bit (20) is rotated under an applied axial load. The cutting elements (28) may comprise teeth formed on the conical surface of the cone (26) (typically referred to as milled teeth) or inserts press-fitted into holes in the conical surface of the cone (26) (such as tungsten carbide inserts).

Many prior art roller cone drill bits have been found to provide poor drilling performance due to problems such as "tracking" and "slipping." Tracking occurs when cutting elements on a drill bit fall into previous impressions formed in the formation by cutting elements at a preceding moment in time during revolution of the drill bit. Slipping is related to tracking and occurs when cutting elements strike a portion of previous impressions and slides into the previous impressions.

In the case of roller cone drill bits, the cones of the bit typically do not exhibit true rolling during drilling due to action on the bottom of the borehole (hereafter referred to as "the bottomhole"), such as slipping. Because cutting elements do not cut effectively when they fall or slide into previous impressions made by other cutting elements, tracking and slipping should be avoided. In particular, tracking is inefficient since there is no fresh rock cut, and thus constitutes a waste of energy. Ideally, every contact of a cutting element on a bottomhole cuts fresh rock. Additionally, slipping should also be avoided because it can result in uneven wear on the cutting elements, which can result in premature failure.

In prior art bits, preventing premature failure due to tracking and slipping is typically accomplished by increasing the hardness of the cutting inserts. For example, U.S. Pat. No. 4,940,099 discloses a rotary drill bit having a plurality of cutters (i.e., roller cones) with rows of cutting inserts. Particularly, certain cutting inserts in a row have cutting surfaces formed with a wear-resistant material having a hardness higher than the hardness of a wear-resistant material on the remaining cutting inserts in the row. In this case, the cutting inserts are positioned in a predetermined pattern intermingled in a generally uniformly spaced pattern with the softer cutting inserts.

However, it has been found that tracking and slipping often occur due to a less than optimum spacing of cutting elements on the bit. Typically, the less than optimum spacing of cutting elements is a generally uniform spaced pattern. In many cases, by making proper adjustments to the arrangement of cutting elements on a bit, problems such as tracking and slipping can be significantly reduced. This is especially true for cutting elements on a drive row of a cone on a roller cone drill bit because the drive row is the row that generally governs the rotation speed of the cones.

Currently, cutting arrangements, such as the arrangement of cutting elements on rows of a roller cone drill bit are designed either by "gut feel," in reaction to field performance, such as the addition of odd pitches to alleviate tracking and slipping, or by trial and error in conjunction with other programs used to predict drilling performance. The problem in these design approaches is that the resulting arrangements are often arrived at somewhat arbitrarily, which can be time consuming in the evolution of the bit design and may or may not lead to drill bits producing desired drilling characteristics.

Therefore, methods for predicting drilling characteristics prior to the manufacturing of drill bits are desired to reduce costs associated with designing bits and to enhance the development of longer lasting bits and/or bits which more aggressively drill through earth formations. Methods are also desired to minimize or eliminate the design and manufacturing of ineffective drill bits which exhibit significant tracking or slipping problems during drilling. Methods are also desired to reduce the time required for designing effective drill bits. Additionally, drill bit designs that exhibit reduced tracking and slipping over prior art bit designs are also desired.

SUMMARY OF THE DISCLOSURE

In general, one aspect of the disclosure relates to a method for designing a roller cone drill bit having a plurality of cutting elements in a row. The method includes defining a pitch pattern for the plurality of cutting elements such that a first group of adjacent cutting elements are arranged in a first pitch and a second group of adjacent cutting elements are arranged in a second pitch in the row, wherein the first group of adjacent cutting elements have a different extension length than the second group of adjacent cutting elements, evaluating the pitch pattern of the plurality of cutting elements in the row, and modifying at least one of the plurality of cutting elements based on the evaluating of the pitch pattern of the plurality of cutting elements.

In another aspect, the disclosure relates to a roller cone drill bit including at least one roller cone, and a plurality of cutting elements arranged in a row on the at least one roller cone, wherein a first group of adjacent cutting elements are arranged in a first pitch in the row and a second group of adjacent cutting elements are arranged in a second pitch in the row. Additionally, wherein the first pitch and the second pitch are different, and wherein the first group of adjacent cutting elements have a different extension length than the second group of adjacent cutting elements.

In another aspect, the disclosure relates to a roller cone drill bit including at least one roller cone, and a plurality of cutting elements arranged in a row on the at least one roller cone, wherein a first group of adjacent cutting elements are arranged in a first pitch in the row and a second group of adjacent cutting elements are arranged in a second pitch in the row. Additionally, wherein the first pitch and the second pitch are different, and wherein the first group is disposed on at least one roller cone on a recessed portion.

In another aspect, the disclosure relates to a method for designing a roller cone drill bit having a plurality of cutting elements in a row. The method includes defining a pitch pattern for the plurality of cutting elements such that a first group of adjacent cutting elements are arranged in a first pitch and a second group of adjacent cutting elements are arranged in a second pitch in the row, wherein the first group of adjacent cutting elements are disposed on a recessed portion, evaluating the pitch pattern of the plurality of cutting elements in the row, and modifying at least one of the plurality of cutting elements based on the evaluating of the pitch pattern of the plurality of cutting elements.

Other aspects and advantages of the disclosure will be apparent from the following description and the appended claims.

DETAILED DESCRIPTION

The present disclosure relates to drill bits for drilling bore holes through earth formations. More particularly, the present disclosure relates to designing drill bits, evaluating cutting structures, and designing cutting elements in view of the evaluation of the cutting structure.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid obscuring the disclosure.

The present disclosure relates to a pitch pattern of cutting elements in a row on a roller cone drill bit. Generally speaking, arrangements (or designs) of cutting elements can be defined by the location of each cutting element in the arrangement. The location of each cutting element may be expressed with respect to a bit coordinate system, cone coordinate system, or a pitch. The pitch is defined as the spacing between cutting elements in a row on a face of a roller cone. For example, the pitch may be defined as the straight line distance between centerlines at the tips of adjacent cutting elements, or, alternatively, may be expressed by an angular measurement between adjacent cutting elements in a generally circular row about the cone axis. See FIG. 3. This angular measurement is typically taken in a plane perpendicular to the cone axis. When the cutting elements are equally spaced in a row about the conical surface of a cone, the arrangement is referred to as having an "even pitch" (i.e., a pitch angle equal to 360° divided by the number of cutting elements).

Figure 1:
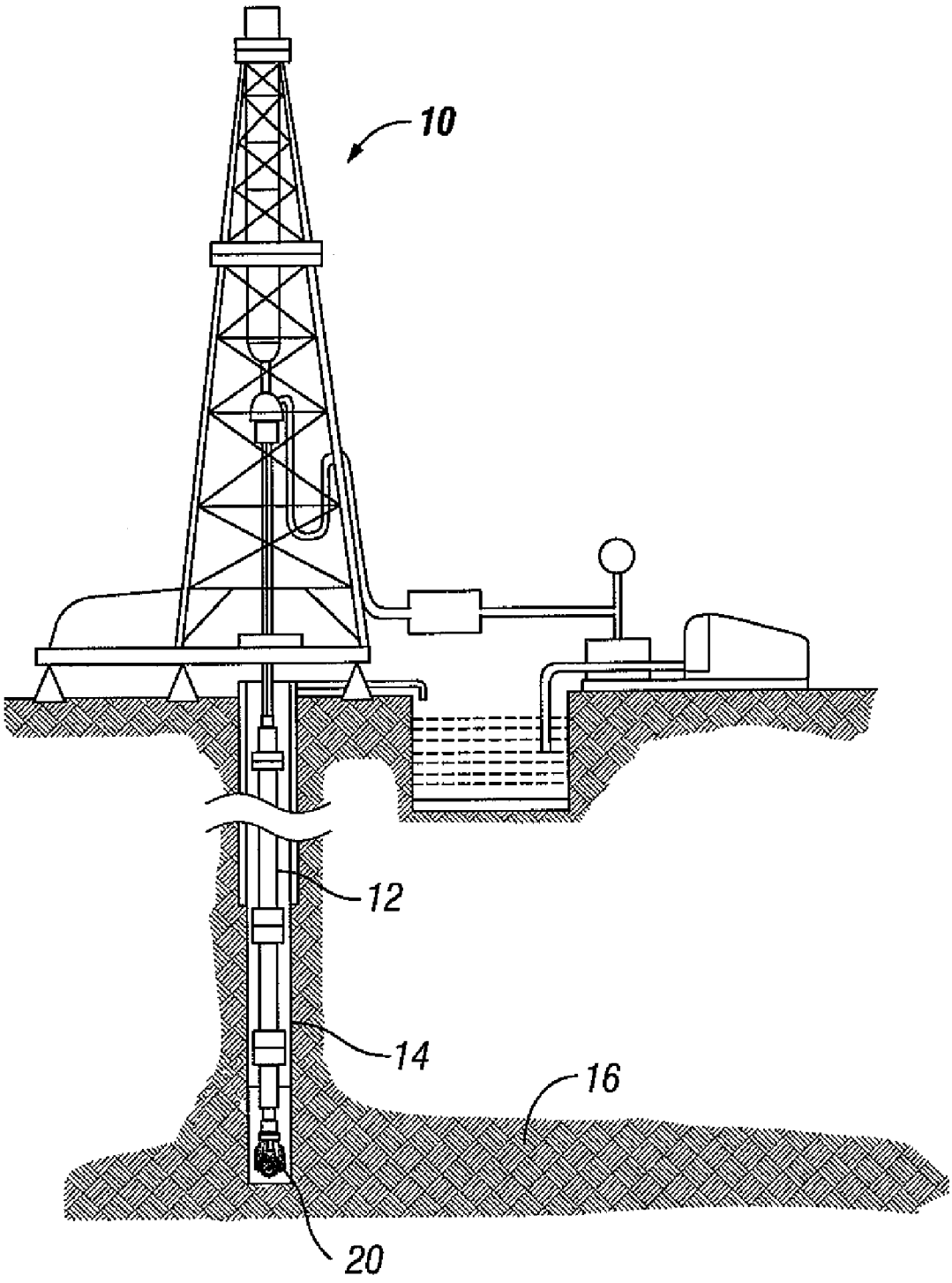
FIG. 1 (Prior Art)
FIG. 1 shows a schematic diagram of one example of a conventional drilling system.
Figure 2:
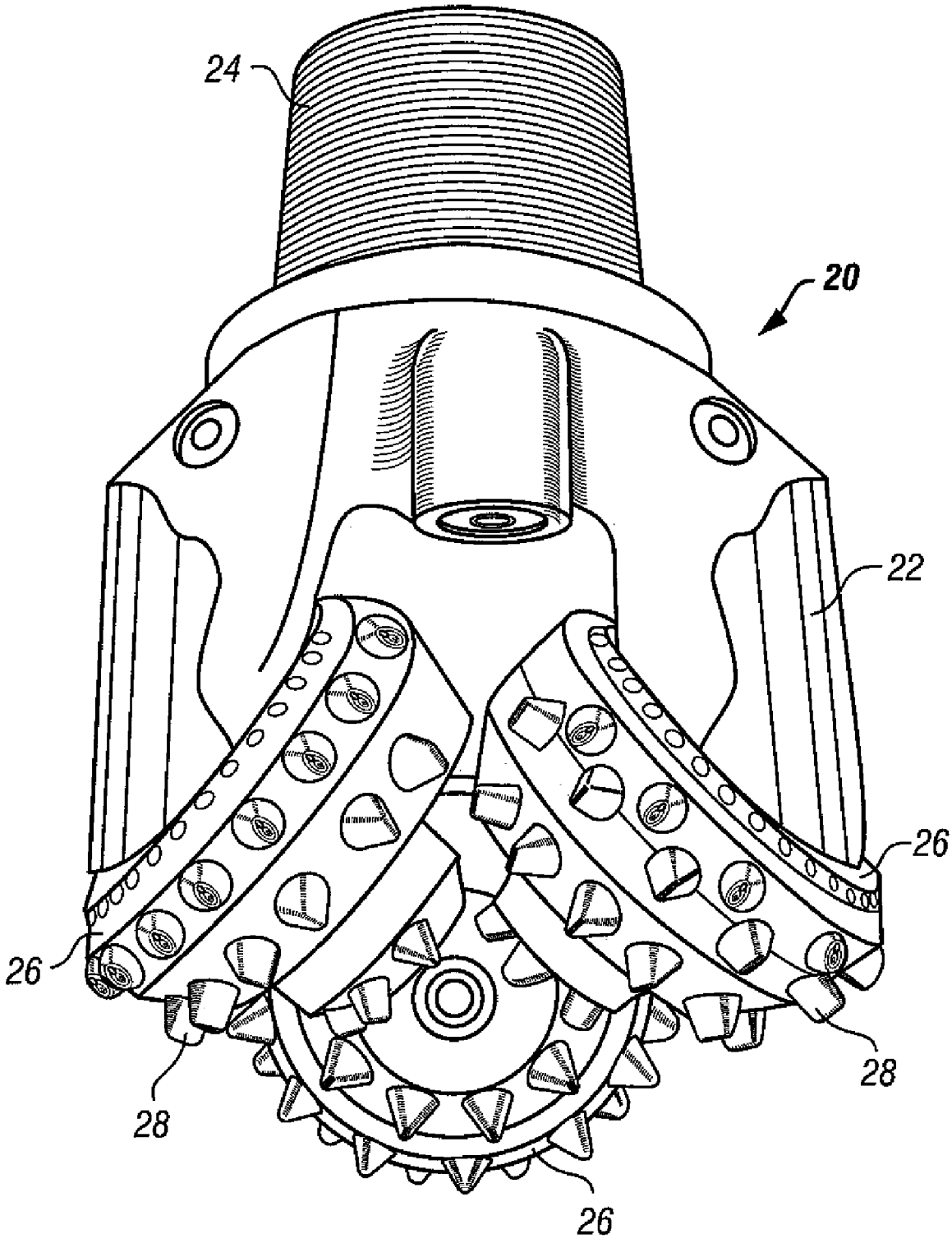
FIG. 2 (Prior Art)
FIG. 2 shows a perspective view of a conventional roller cone drill bit.
Figure 3:
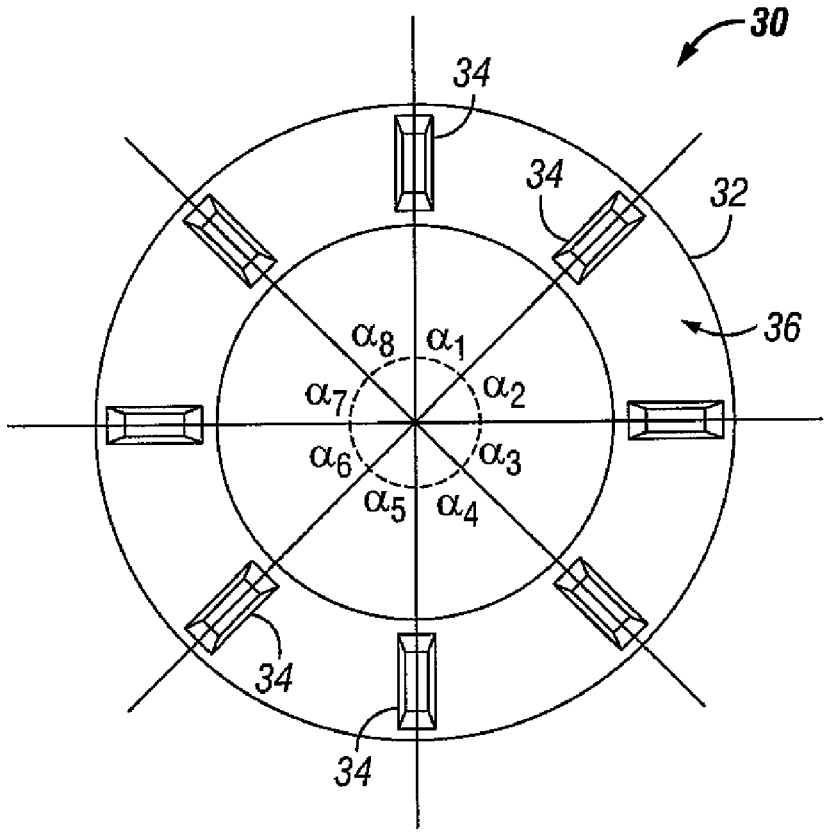
FIG. 3 shows a schematic layout illustrating an even cutting element spacing arrangement for a row on a roller cone drill bit.

Referring to FIG. 3, one example of a cutting arrangement (30) proposed for a row (36) of a roller cone (32) is shown. The arrangement (30) includes eight cutting elements (34) spaced apart and arranged in a circular row (36). In this case, the amount of spacing between each pair of adjacent cutting elements (34) is defined in terms or a pitch angle, $\alpha_i$. This type of spacing arrangement for a row of cutting elements on a roller cone is often referred to as a "spacing pattern" or a "pitch pattern" for a row.

Figure 4:
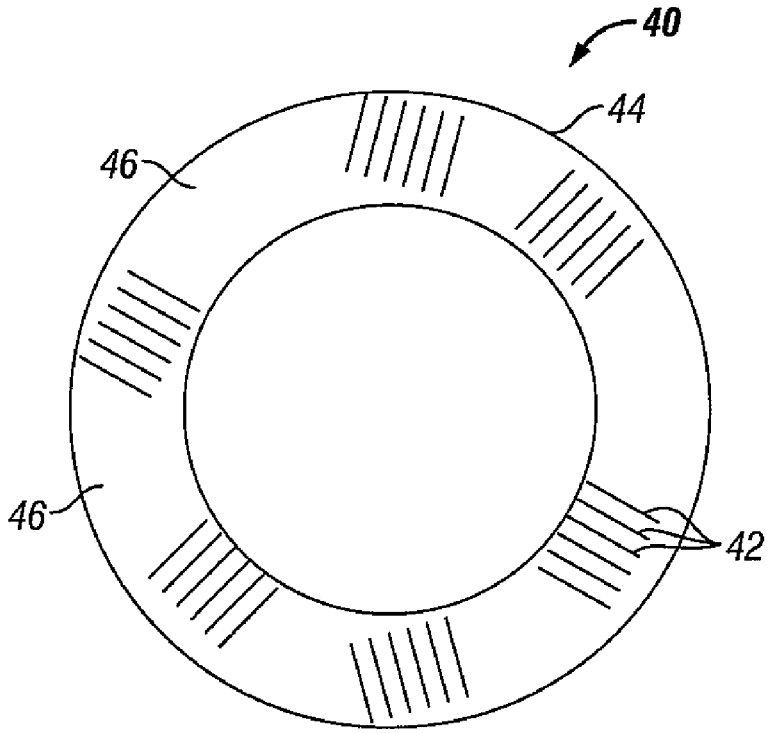
FIG. 4 shows a schematic layout illustrating a bottomhole hit pattern made by a cutting element arrangement for a row of a roller cone drill bit, similar to the arrangement in FIG. 3, during a number of revolutions of the bit.

One example of a pattern of impressions made on a bottomhole by cutting elements in a row on a roller cone of a roller cone drill bit (such as row 36 in FIG. 3) is shown in FIG. 4. In this example, each impression made by a cutting element that contacted the bottomhole during the rotation of the bit is referred to as a "hit." Although the actual impression made by a cutting element on a roller cone drill bit is more of an area of scrape often resulting in the formation of a crater, in the example shown and discussed below, each impression will be simply represented by a hit located at the center of that area of scrape. The location of each hit on the bottomhole will be referred to as a "bottomhole hit location." The collection of hits made on the bottomhole during a selected number of revolutions of the bit will be referred to as a "bottomhole hit pattern."

The bottomhole hit pattern (40) shown in FIG. 4 includes a number of hits (42) made on the bottomhole (44) by cutting elements in one row on a roller cone of a roller cone drill bit (not shown) during a selected number of revolutions of the bit on the bottomhole (44). Most of the hits (42) in this example occurred in close proximity to other hits, which resulted in a bottomhole hit pattern (40) with wide gaps (46) of uncut formation separating clustered hits on the bottomhole (44).

The bottomhole hit pattern shown in FIG. 4 is typically considered undesirable because the hits occur in close proximity to previous hits with wide gaps of formation. This type of pattern typically signifies a high likelihood of tracking and slipping during drilling, especially if the arrangement producing the pattern is used in a drive row. This bottomhole hit pattern may also indicate a poor use of hits when the crater sizes corresponding to each hit are larger than the distances between the hits.

Figure 5:
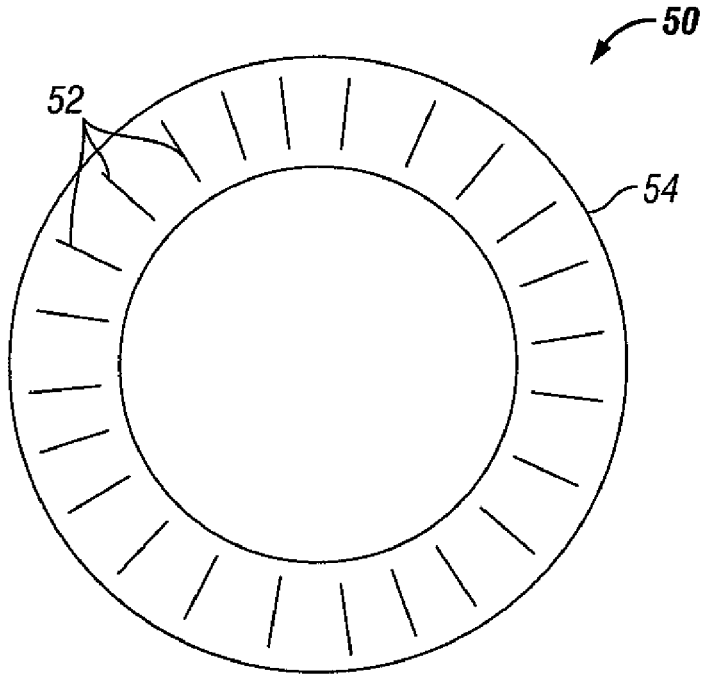
FIG. 5 shows a schematic layout illustrating a preferred bottomhole bit pattern in comparison to the bottomhole hit pattern shown in FIG. 4.

To minimize a potential for tracking and slipping and/or to improve a cutting efficiency of a cutting arrangement, an arrangement may be desired that results in a more even distribution of hits on the bottomhole during a selected number of revolutions of the drill bit. For example, a bottomhole hit pattern (50) as shown in FIG. 5 may be considered more preferable than the bottomhole hit pattern (40) shown in FIG. 4 because this bottomhole hit pattern (50) includes a plurality of hits (52) that are substantially evenly spaced about the section of the bottomhole (54) cut by the cutting arrangement.

Figure 6:
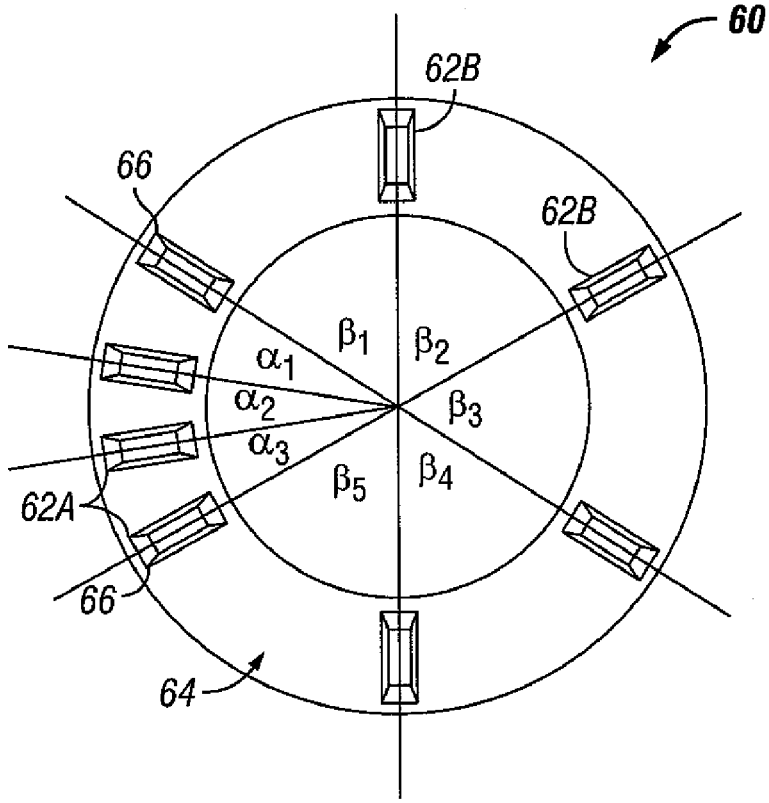
FIG. 6 shows a schematic layout illustrating an un-even cutting element spacing arrangement for a row on a roller cone drill bit.

As previously mentioned, to achieve a substantially even distribution on the bottomhole during a selected number of revolutions of the drill bit, the pitch of the cutting elements are varied in a single row. For example, the cutting elements are arranged in odd pitches on a row, i.e., cutting elements are arranged to have an uneven pitch. An example of a cutting arrangement having odd pitches is shown in FIG. 6. The cutting arrangement (60) includes eight cutting elements (62A and 62B) in a circumferential row (64) with a total of eight spaces (measured as angles $\alpha_i$ and $\beta_i$) provided between cutting elements. Three of the eight spaces between the cutting elements are substantially equal to each other (measured as angle $\alpha_i$). These cutting elements (62A) form a first group. On the other hand, the remaining five spaces between the cutting elements are also substantially equal to each other (measured as angle $\beta_i$). These cutting elements (62B) form a second group. The pitch angle $\alpha_i$ is substantially different from pitch angle $\beta_i$, i.e., $\beta_i > \alpha_i$. The cutting elements (66) disposed between $\alpha_i$ and $\beta_i$ are considered to be at the "pitch break."

Figure 16:
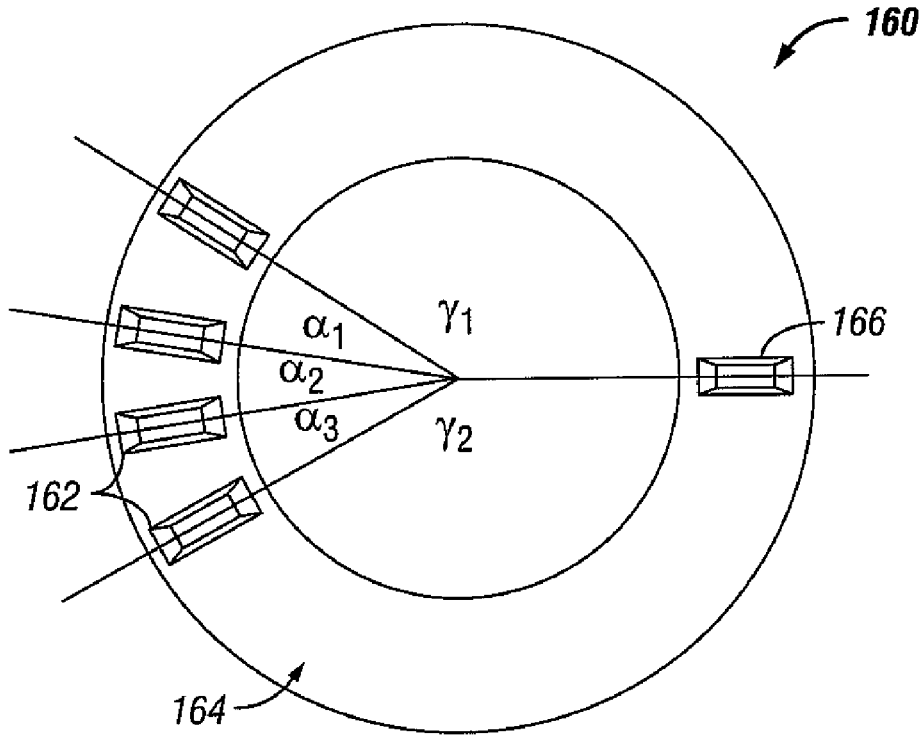

One skilled in the art will appreciate that in another embodiment in accordance with an aspect of the present disclosure, cutting elements are arranged in a cutting arrangement (160) as shown in FIG. 16. The cutting arrangement (160) includes five cutting elements (162 and 166) in a circumferential row (164) with a total of five spaces (measured as angles $\alpha_i$ and $\gamma_i$) provided between the cutting elements. Three of the five spaces between the cutting elements are substantially equal to each other (measured as angle $\alpha_i$). These cutting elements (162) form a first group. On the other hand, the remaining two spaces between cutting element (166) are also substantially equal to each other (measured as angle $\gamma_i$). Embodiments as described above are cases in which one cutting element has two large pitches separating a single cutting element from a group of cutting elements.

In one or more embodiments, the pitch angles for different groups of cutting elements may typically vary by at least 10%. In many cases, the difference may be 15% or more and, in some cases, 20% or more. Additionally, in one or more embodiments, all of the pitches in a group of cutting elements may be substantially the same, however, not necessarily identical. For example, adjacent pitches that are 45.3° and 45.4° would be considered to have the same pitch angle, and thus, in the same group of cutting elements. In another embodiment, cutting elements of the same group may differ by as much as 10%, depending on the size of the pitch and the amount of difference between pitches in different groups. In many cases, the difference may be 5% or less and, in some cases, 2% or less. Finally, in one or more embodiments, a row may also include one or more additional spaces (pitches) having measurements different from the spaces in a first and second group of cutting elements.

Figure 7:
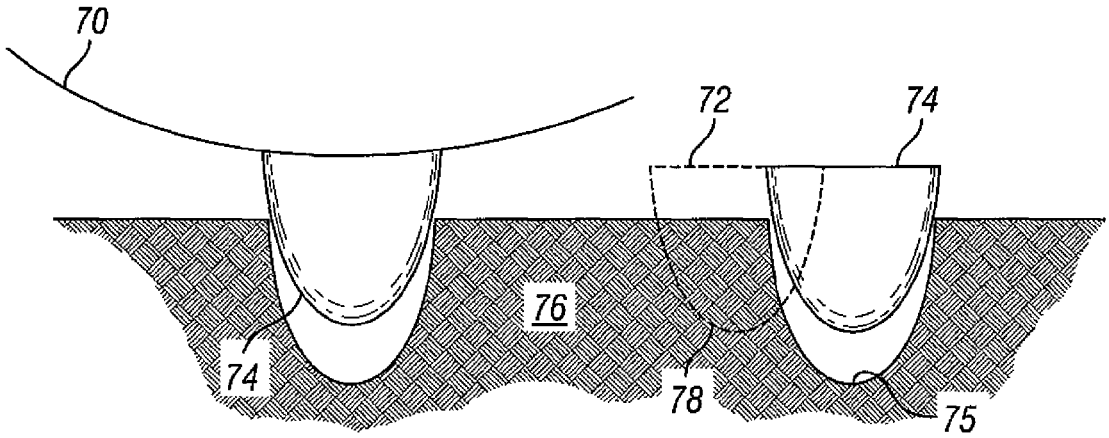
FIG. 7 shows a schematic diagram illustrating cutting elements having differing pitches interacting with the earth formation.

Referring back to FIG. 6, in one application, the cutting arrangement (60) reduces the tendency that cutting elements in the first group (62A) will "track," i.e., fall, or slide into impressions made by the second group (62B), and vice versa. However, based on the wear condition of bits for a given application, it may be desired to change the geometry, material, or other attribute of one or more cutting elements in the group to extend die useful life of the drill bit. For example, in one application, it was determined that while the cutting elements in the first group (62A) having a more narrow pitch may not track the cutting elements in the second group (62B), one or more cutting elements in the first group (62A) may experience preferential wear and premature failure, particularly, cutting elements (66 of the first group 62A) located at the pitch break. FIG. 7 shows an example schematic of impressions created in earth formation by a group of cutting elements having a standard pitch and the resulting interaction of a group of cutting elements having a narrower pitch.

The roller cone (70) includes two groups of cutting elements, represented as cutting elements (72 and 74). The group of cutting elements represented as cutting elements (74) are arranged in a standard pitch, whereas the group of cutting elements represented as cutting element (72) are arranged in a relatively narrower pitch. In this example, the cone (70) is moving in a clockwise direction and cutting elements (74) create impressions (75) in the earth formation (76) at the standard pitch. Consequently, the difference in pitch between cutting elements (72 and 74) results in a leading side (78) of cutting element (72) interacting more aggressively with earth formation (76) than the trailing side of the tooth. Typically, when a cutting element experiences higher forces and/or stresses in a repetitive manner on or about the same point, the cutting element tends to wear preferentially at this point. One skilled in the art will understand that preferential wear leads to "non-ideal" dull condition of the cutting element, and, ultimately, premature breakage and/or failure. The dull condition may be defined as the state of wear of a cutting element resulting in substantially less cutting action as compared to an initial state of the cutting element. One skilled in the art would appreciate that in another application it may be desired to change the geometry, material, or other attribute of cutting elements in one group based on the dull conditions of bits. For example, the size of one or more cutting elements having larger pitch breaks on both sides of the cutting element may be increased to compensate for the stresses or expected load on the cutting element during drilling.

Figure 8:
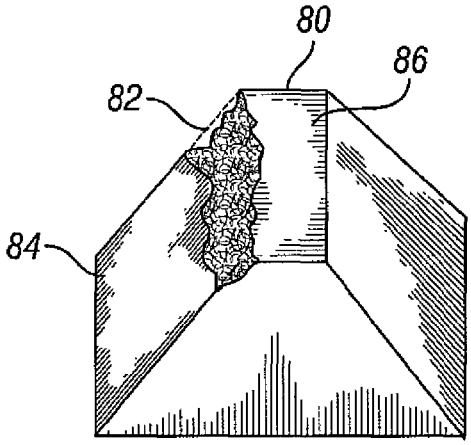
FIG. 8 shows a schematic diagram of an example of a cutting element having a "non-ideal" dull condition.
Figure 9:
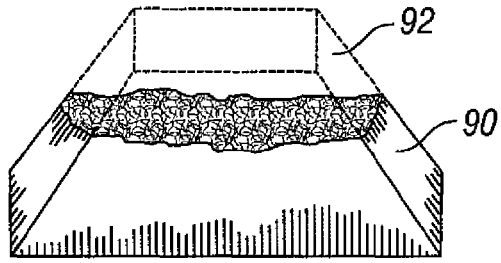
FIG. 9 shows a schematic diagram of an example of a cutting element having a preferred dull condition.

FIG. 8 shows a schematic of an example of a cutting element having a "non-ideal" dull condition. The typical dull cutting element (80) is shown with a solid line, whereas the original cutting element (82) is shown with a dotted line. A leading side (84) of the typical dull cutting element (80) is fractured along the crest (86). In contrast, FIG. 9 shows a schematic of an example of a cutting element having an "ideal" dull condition. The ideal dull cutting element (90) is shown with a solid line, whereas the original cutting element (92) is shown with a dotted line. In this case, the cutting element is evenly worn, i.e., no one point of the cutting element experiences substantially more wear than any other point on the cutting element.

In the present disclosure, the pitch pattern is used to evaluate a cutting arrangement of cutting elements on a single row. In accordance with the evaluating the pitch pattern, a particular cutting element (or a group of cutting elements) is targeted and modified to improve the dull condition of the cutting element.

Figure 10:
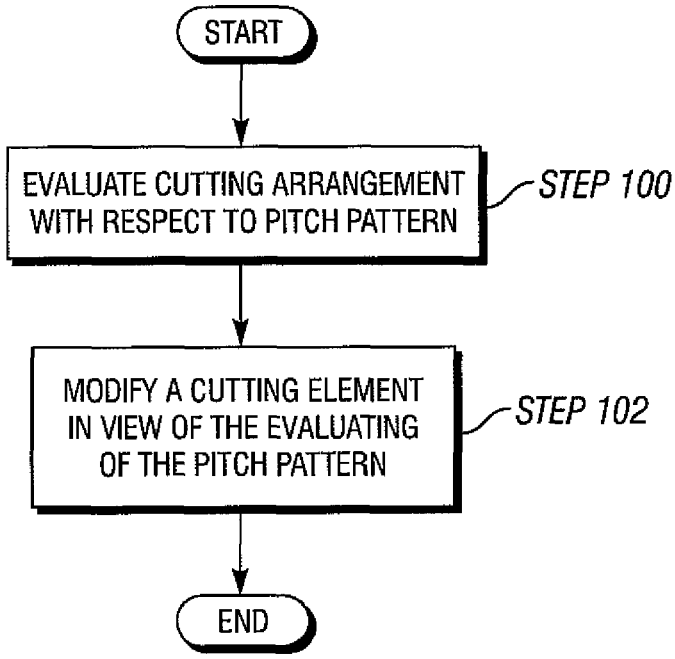
FIG. 10 shows a flow diagram of designing a roller cone drill bit in accordance with one or more embodiments of the present disclosure.

FIG. 10 shows a flow diagram of designing a roller cone drill bit in accordance with one or more embodiments of the present disclosure. In FIG. 10, the cutting arrangement is evaluated with respect to the pitch pattern (Step 100). In other words, the pitch angles for groups of cutting elements are determined. Additionally, cutting elements are identified that are located at or near a pitch break.

In one or more embodiments of the present disclosure, a simulation tool is used in conjunction with a computer-aided design (CAD) tool to evaluate a pitch pattern of a row of teeth on a roller cone drill bit. In one or more embodiments of the present disclosure, a computer aided design tool and/or a roller cone drill bit simulation tool is used to evaluate the pitch pattern of a cutting arrangement, such as the methods disclosed in U.S. Pat. No. 6,516,293 issued to Smith International, Inc., and U.S. Provisional Application No. 60/473,522 filed on May 27, 2003. Both of these are assigned to the assignee of the present disclosure and are incorporated herein by reference.

For example, a user may input into a CAD tool design specifications of a roller cone bit having a cutting element arrangement as shown in FIG. 6. In FIG. 6, the pitch pattern shows a series of five angular displacements that are substantially larger than a series of three angular displacements. Moreover, the cutting elements may be fully evaluated by using various perspective views of this row, observing the simulated cutting action of the row with the specified pitch pattern, or simply observing the pitch pattern itself.

In accordance with this evaluation, the properties of one or more cutting element are modified to improve the dull condition of the cutting element (Step 102). The properties may include geometry and/or hardness of the cutting elements In one or more embodiments of the present disclosure, cutting elements at or near pitch breaks are modified. More particularly, a cutting element may be modified to compensate for a leading (or trailing) edge at a side of cutting elements, which is adjacent to a large pitch. Therefore, continuing with the example of FIG. 6, the group of cutting elements (62A) (or simply one of the cutting elements (66)), are modified to improve the dull condition of cutting elements (62A). For example, when evaluating the tooth during simulation, a three-dimensional finite element analysis model may be provided to show stresses on each part of the cutting element. The cutting element may indicate greater stresses are occurring on the leading side of a tooth. Further, in conjunction with the pitch pattern, it is determined that the tooth experiencing the high stresses on the leading side is located at a pitch break. To compensate for the high stresses experienced by the cutting element, the cutting element is modified to relieve these stresses, e.g., by adding a bulk. One of ordinary skill in the art will appreciate that there are a variety of ways to reduce cutting elements stresses, which result in failure and/or wear (which is more generally referred to as the "dull condition" of a cutting element).

Figure 11:
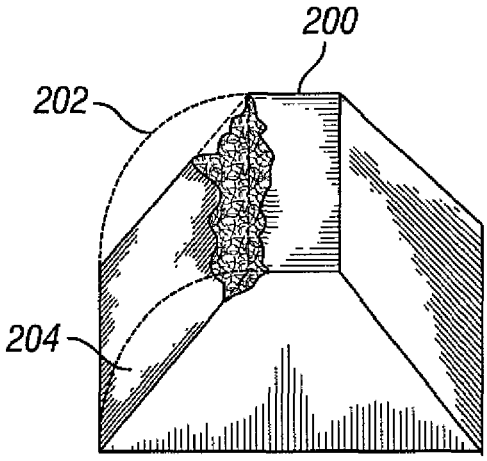
FIGS. 11 and 12 show schematic diagrams of a modified geometry of a cutting element in accordance with one or more embodiments of the present disclosure.
Figure 12:
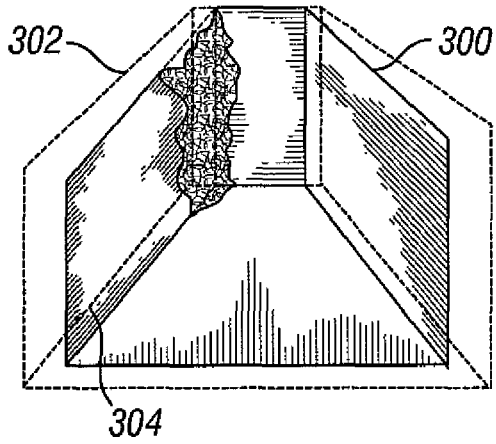

For, example, in one or more embodiments, a geometry of cutting elements (62A) is modified to improve the dull condition of the cutting element (66). The geometry may include, for example, a shape, a size (e.g., a diameter), etc. In one embodiment, the dull condition is improved by adding a bulk to a leading side of a cutting element. FIG. 11 shows a schematic of a "non-ideal" dull cutting element having a bulk. In FIG. 11, the typical dull cutting element (200) is modified by adding the bulk (202) (shown with dotted line) to the leading side (204). The bulk (202) allows the forces and/or stresses experienced by the cutting element (200) to be more evenly distributed, thereby improving the dull condition of the cutting element (200). In another embodiment, the dull condition is improved by widening the crest of the cutting element. FIG. 12 shows a schematic of a "non-ideal" dull cutting element having a widened crest. In FIG. 12, the typical dull cutting element (300) is modified by widening the crest of the cutting element. The widened crest (302) is represented with a dotted line. In this case, the leading side (304) experiences less forces and stress than the typical dull cutting element, as the forces and/or stresses are distributed over a greater area. One skilled in the art will appreciate that there are a variety of ways to improve the dull condition of a cutting element. In particular, those having ordinary skill in the art will appreciate that other geometries, such as providing relieved portions may improve stresses on individual cutting elements.

In another aspect of the present disclosure, a material type or a material property of cutting elements (62A) is modified to improve the dull condition of the cutting element (62A).

One skilled in the art will appreciate that cutting elements are typically comprised of cemented tungsten carbide. Cemented tungsten carbide generally refers to tungsten carbide (WC) particles dispersed in a binder metal matrix, such as iron, nickel, or cobalt. Tungsten carbide in a cobalt matrix is the most common form of cemented tungsten carbide, which is further classified by grades based on the grain size of WC and the cobalt content.

Further, one skilled in the art will appreciate that tungsten carbide grades are primarily made in consideration of two factors that influence the lifetime of a tungsten carbide insert: wear resistance and toughness. As a result, cutting elements known in the art are generally formed of cemented tungsten carbide with average grain sizes about less than 3 um as measured by ASTM E-112 method, cobalt contents in the range of about 6%-16% by weight and hardness in the range of about 86 Ra to 91 Ra; however, coarser grain carbides may be used.

For a WC/Co system, it is typically observed that the wear resistance increases as the grain size of tungsten carbide or the cobalt content decreases. On the other hand, the fracture toughness increases with larger grains of tungsten carbide and greater percentages of cobalt. Thus, fracture toughness and wear resistance (i.e., hardness) tend to be inversely related: as the grain size or the cobalt content is decreased to improve the wear resistance of a specimen, its fracture toughness will decrease, and vice versa.

Due to this inverse relationship between fracture toughness and wear resistance (i.e., hardness), the grain size of tungsten carbide and the cobalt content are selected to obtain desired wear resistance and toughness. For example, a higher cobalt content and larger WC grains are used when a higher toughness is required, whereas a lower cobalt content and smaller WC grains are used when a better wear resistance is desired.

Accordingly, in one embodiment, the dull condition is improved by decreasing the amount of carbide of which the cutting elements is comprised. Alternatively, the dull condition is improved by increasing the amount of cobalt of which the cutting element is comprised. Alternatively, the dull condition is improved by decreasing the carbide grain size of which the cutting element is comprised. Similarly, in another embodiment, the dull condition is improved by increasing the toughness of the cutting element. Alternatively, the dull condition is improved by increasing the hardness of the cutting element. Those skilled in the art will appreciate that other material types and/or properties can be used, so as to achieve an improved dull condition of a cutting element.

In one or more embodiments of the present disclosure, any or all a geometry, a material type, and/or a material property of a cutting element are modified to improve the dull condition of the cutting element.

In one or more embodiments of the present disclosure, more than one row of a roller cone drill bit, including a gage row and a heel row, are modified.

Figure 13:
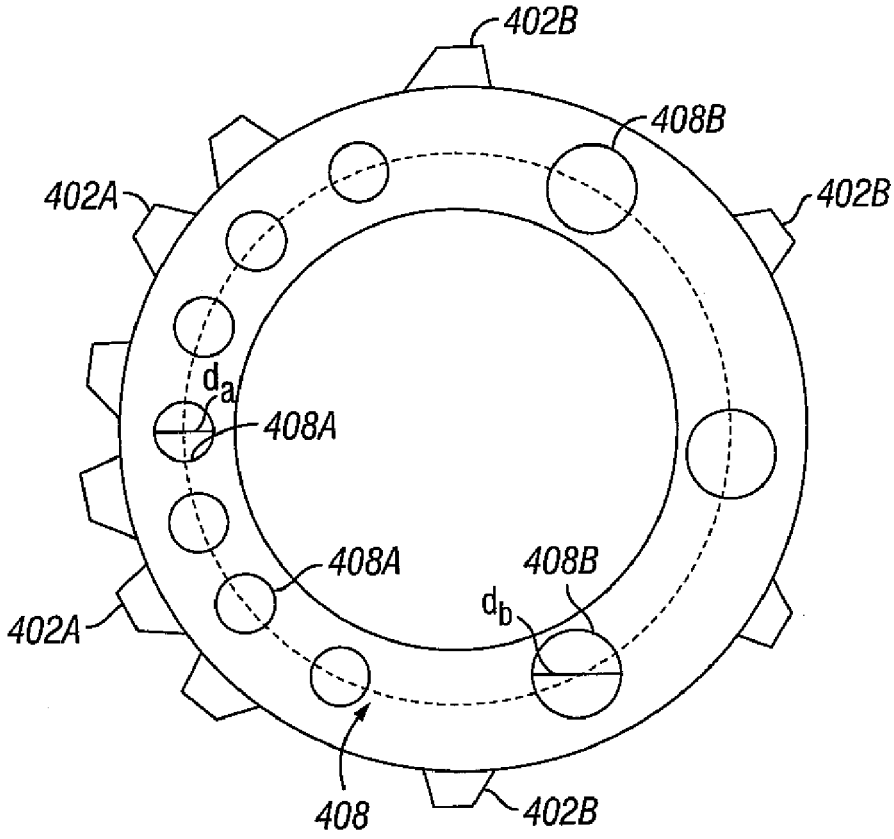
FIGS. 13-16 show schematic diagrams of a cutting element spacing arrangement for a row on a roller cone drill bit.

For example, diameters of cutting elements on a heel row are selected based on the pitch pattern. FIG. 13 shows a heel row (408) with cutting elements (408A, 408B). The dotted line indicates that the centerlines of the cutting elements are substantially aligned to form the heel row of the cone. A first group of cutting elements (408A) having a diameter ($d_a$) are provided on the heel row (408) and aligned between cutting elements (402A) on a gage row, whose pitch is relatively small (or narrow). Further, the second group of cutting elements (408B) having a diameter ($d_b$) are provided on the heel row (408) aligned between cutting elements (402B) on a gage row, whose pitch is relatively large. The diameter ($d_a$) of cutting elements (408A) is substantially smaller than that of the diameter ($d_b$) of the cutting elements (408B). One of ordinary skill in the art will appreciate that a cutting element on the heel row being "aligned between" the cutting elements on the gage row indicates the cutting element on the heel row is azimuthally located between two cutting elements on a gage row and not necessarily that the cutting elements are located at the same radial distance.

Figure 14:
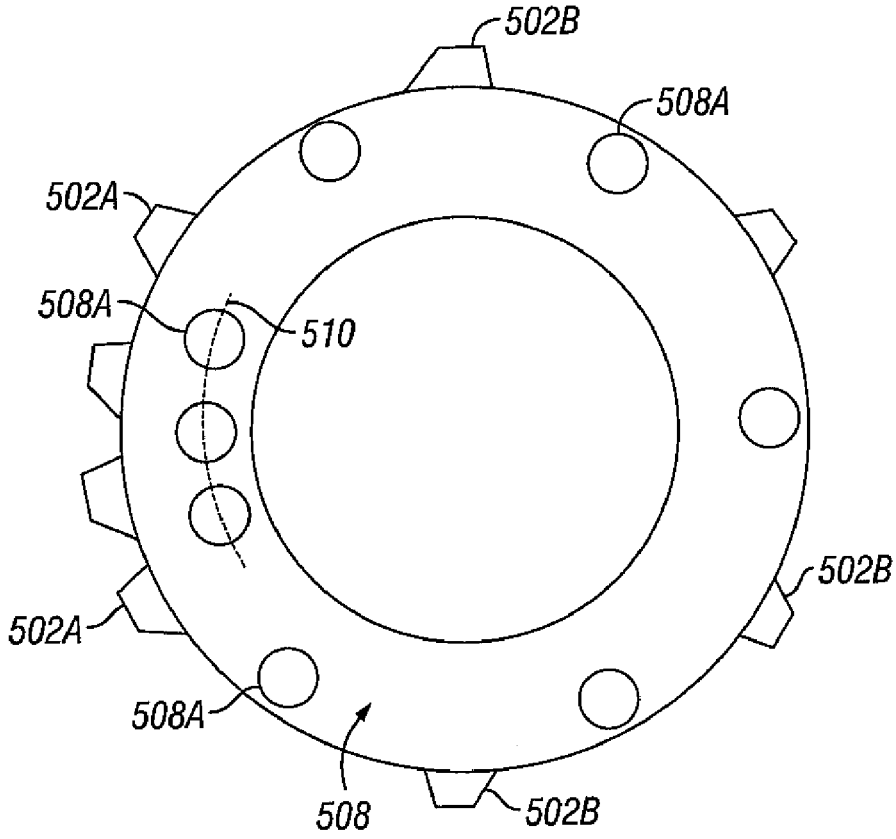

In another example, cutting elements on the heel row are positioned at different geometric locations based on the pitch pattern. As shown in FIG. 14, in between the small pitches, the cutting elements (508A) are limited in proximity to the cutting elements (502A) on the gage row. More particularly, centerlines of these cutting elements (508A) are aligned to form a band (510) that encompasses approximately 25% of the surface of the cone. This band (510) of cutting elements (508A) is limited in proximity to the gage row. In between the large pitches, cutting elements (508A) can be placed closer to the cutting elements (502B) on the gage row. More particularly, centerlines of the other cutting elements (508A) are aligned to form a band (not shown) that encompasses approximately 75% of the surface of the cone. This band (not shown) of cutting elements (508A) is proximal to the gage row. The two bands of cutting elements (508A) work together to form a heel row (508).

Figure 15:
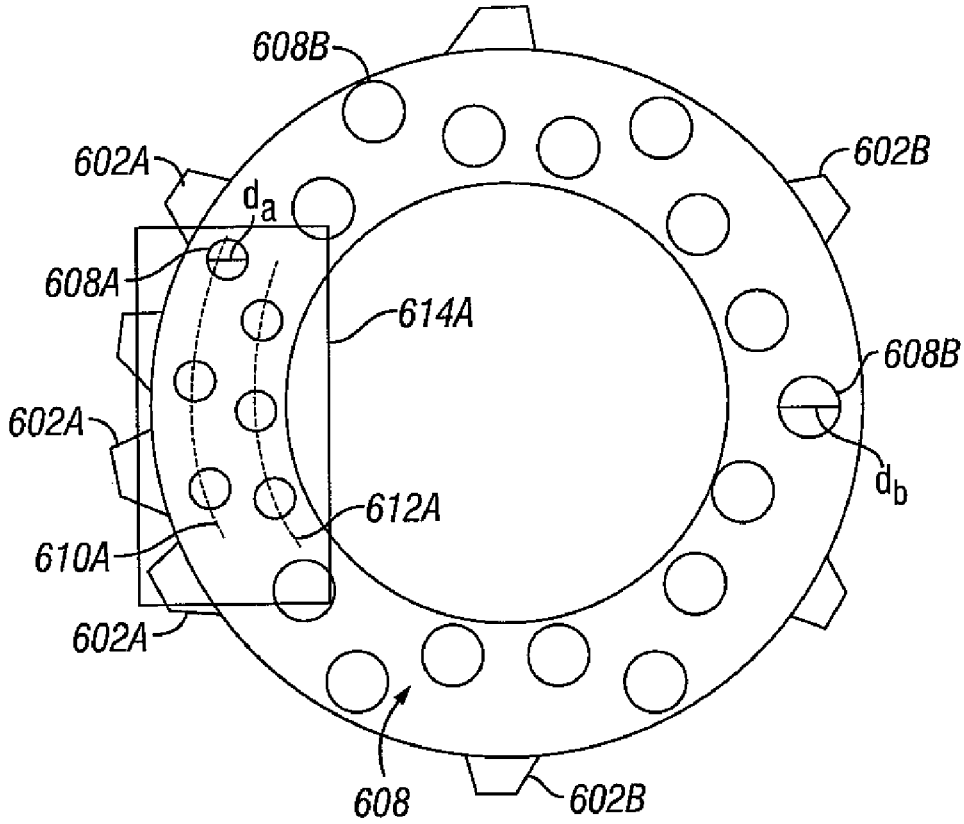

In another example, cutting elements of various diameters are arranged on a staggered row or gage row based on the pitch pattern. As shown in FIG. 15, in between the small pitches, the cutting elements (608A) are staggered and the diameters ($d_a$) of the cutting elements (608A) are smaller. In between the large pitches, cutting elements (608B) are staggered and the diameters ($d_b$) of the cutting elements (608B) are relatively larger. In this example, centerlines of respective cutting elements (608A) form two bands, i.e., an upper band (610A) and a lower band (612A). The upper band (610A) and the lower band (612A) work together to form a staggered band (614A). The staggered band encompasses approximately 25% of the surface of the cone. Similarly, centerlines of respective cutting elements (608B) form upper and lower band, which work together to form a second staggered band. The second staggered band encompasses approximately 75% of the surface of the cone. The two staggered bands work together to form a staggered row.

One of ordinary skill in the art will appreciate that the cutting elements whose centerlines are aligned form bands or partial rows on a surface of a cone. These bands may encompass 25%-75% of the surface of the cone and may work in conjunction with one or more other bands to form a row on the surface of a cone. Additionally, two or more bands positioned above (or below) one another such that the cutting elements are staggered may form a staggered band. These staggered bands may encompass 25%-75% of the surface of the cone and may work in conjunction with one or more other bands to form a staggered row on the surface of a cone.

While the above examples may have been described with respect to a particular row, one of ordinary skill in the art will appreciate that the present disclosure may be an inner row, an outer row, a gage row, or a heel row.

Figure 17:
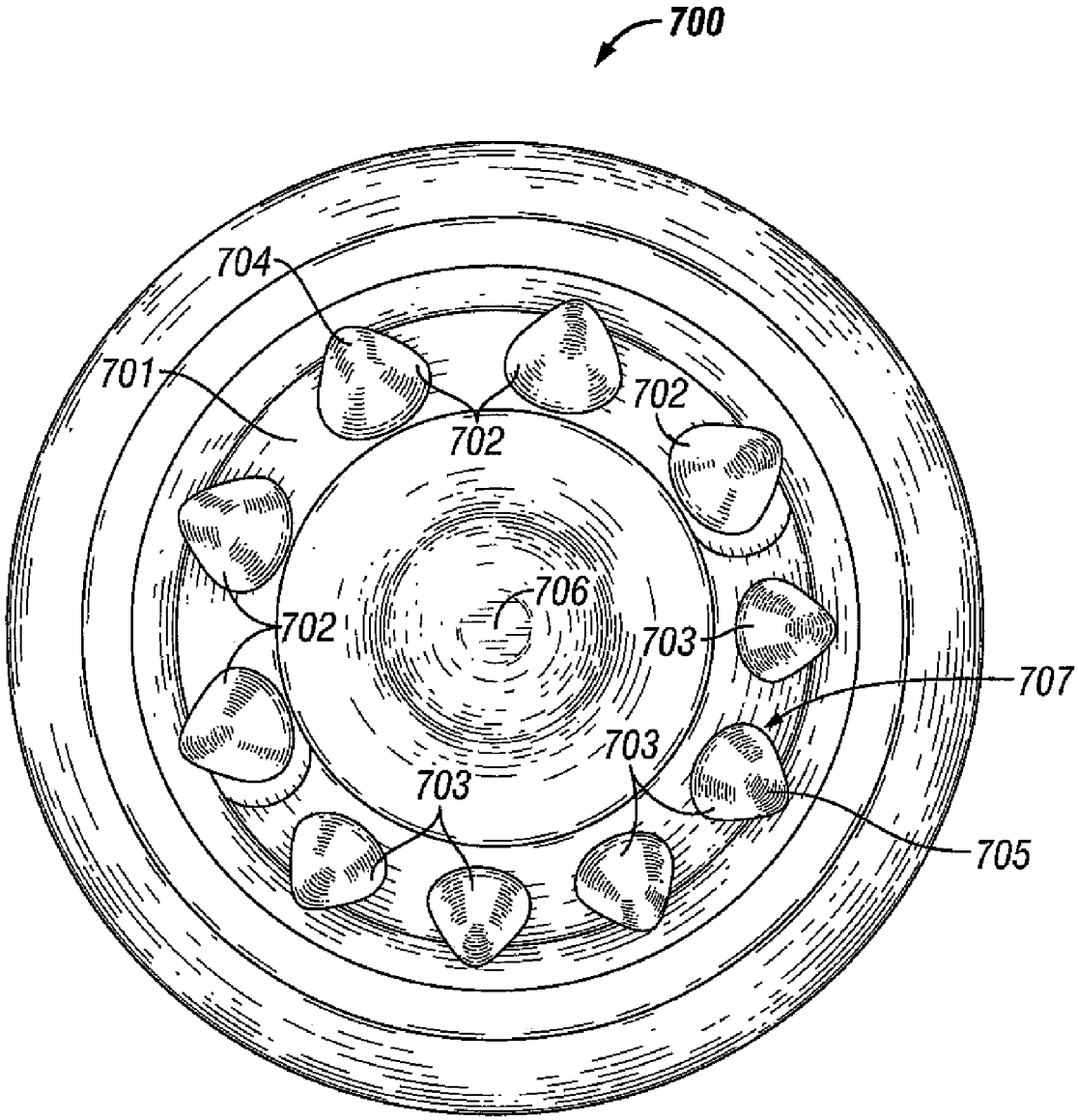
FIG. 17 shows a top view of a roller cone with a recessed pitch according to embodiments of the present application.

Referring now to FIG. 17, a top view of a roller cone 700 with a recessed portion 701 in accordance with embodiments of the present disclosure is shown. In this embodiment, roller cone 700 includes a first group 702 of cutting elements 704 having a first pitch, and a second group 703 of individual cutting elements 705 having a second pitch. As illustrated, the cutting elements 704 in first group 702 are larger than cutting elements 705 in second group 703. In other embodiments, cutting elements 704 in first group 702 may include different geometries, material types, or material properties from cutting elements 705 in second group 703, in addition to, or in place of a size difference of such cutting elements 704 and 705, as presently illustrated. For example, in other embodiments, cuttings elements 704 in first group 702 may be of equal size and similar geometry to cutting elements 705 in second group 703.

In one embodiment, recessed portion 701 may be defined as a depression in the surface of roller cone 700 connecting a group of cutting elements in a particular group having a specified pitch. Inclusion of recessed portion 701 may thereby expose a greater volume of an individual cutting element 704 to contact a formation during drilling. Thus, in certain embodiments, cutting element 704 in group 702 may be of same or similar size as cutting element 705 in group 703. As such, roller cone 700, in accordance with embodiments disclosed herein, may include a first group 702 of adjacent cutting elements 704 arranged having a first pitch in a row, and a second group 703 of cutting elements 705 arranged having a second pitch in the row, wherein the first group 702 and the second group 703 have different pitches, and wherein the first group 702 is disposed on roller cone 700 on a recessed portion 701. Those of ordinary skill in the art will appreciate that in certain embodiments the pitch of first group 702 may be greater than the pitch of second group 703. However, in other embodiments, the pitch of first group 702 may be smaller than the pitch of second group 703. In still other embodiments, a roller cone having more than two groups of cuttings elements may include a plurality of groups of cutting elements having a first pitch, and a plurality of groups of cutting elements having a second pitch that is either greater or smaller than the first pitch. In such an embodiment, one or more of the groups may have cutting elements disposed with equal pitches.

Those of ordinary skill in the art will appreciate that in other embodiments, roller cone 700 may include multiple recessed portions 701 and non-recessed portions 707. Thus, a single roller cone 700 may have a plurality of groups 702 and 703 disposed on a plurality of recessed and non-recessed portions 701 and 707.

Figure 18:
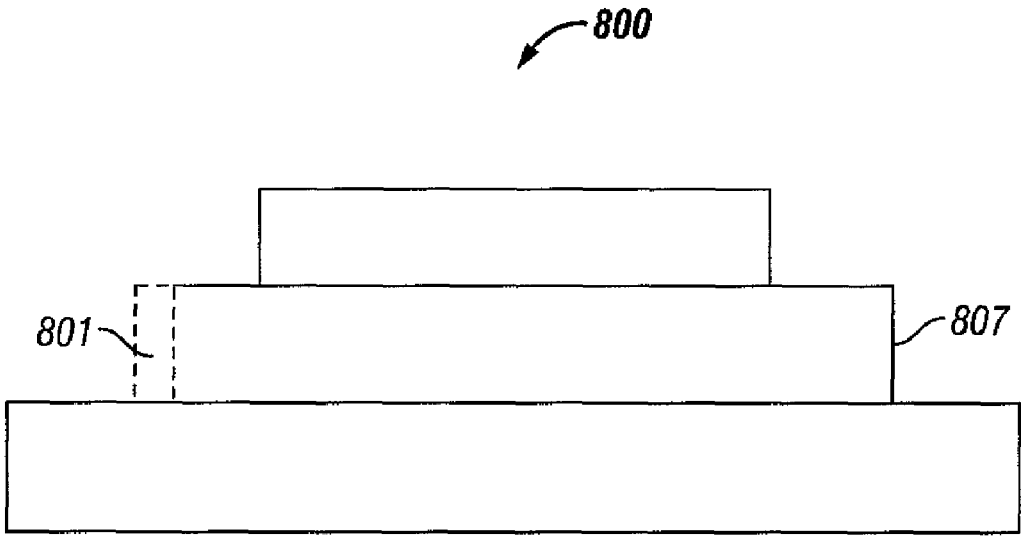
FIG. 18 shows a cross-sectional schematic of a roller cone according to embodiment of the present disclosure.

Referring to FIG. 18, a cross-sectional schematic of a roller cone 800 according to embodiments of the present disclosure is shown. In this embodiment, roller cone 800 includes a recessed portion 801, indicated by the dashed section, and a non-recessed portion 807. In some embodiments, recessed portion 801 may be formed by designing roller cone 800 to initially include such recessed portion 801. In other embodiments, recessed portion 801 may be formed by milling the surface of roller cone 800 to remove a determined volume of, for example, steel. In still other embodiments, recessed portion 801 may be artificially formed by applying a uniform layer of hardfacing to non-recessed portion 807, thereby artificially forming recessed portion 801. Those of ordinary skill in the art will recognize other methods of forming recessed portion 801 may exist, and as such, are within the scope of the present disclosure.

Figure 19:
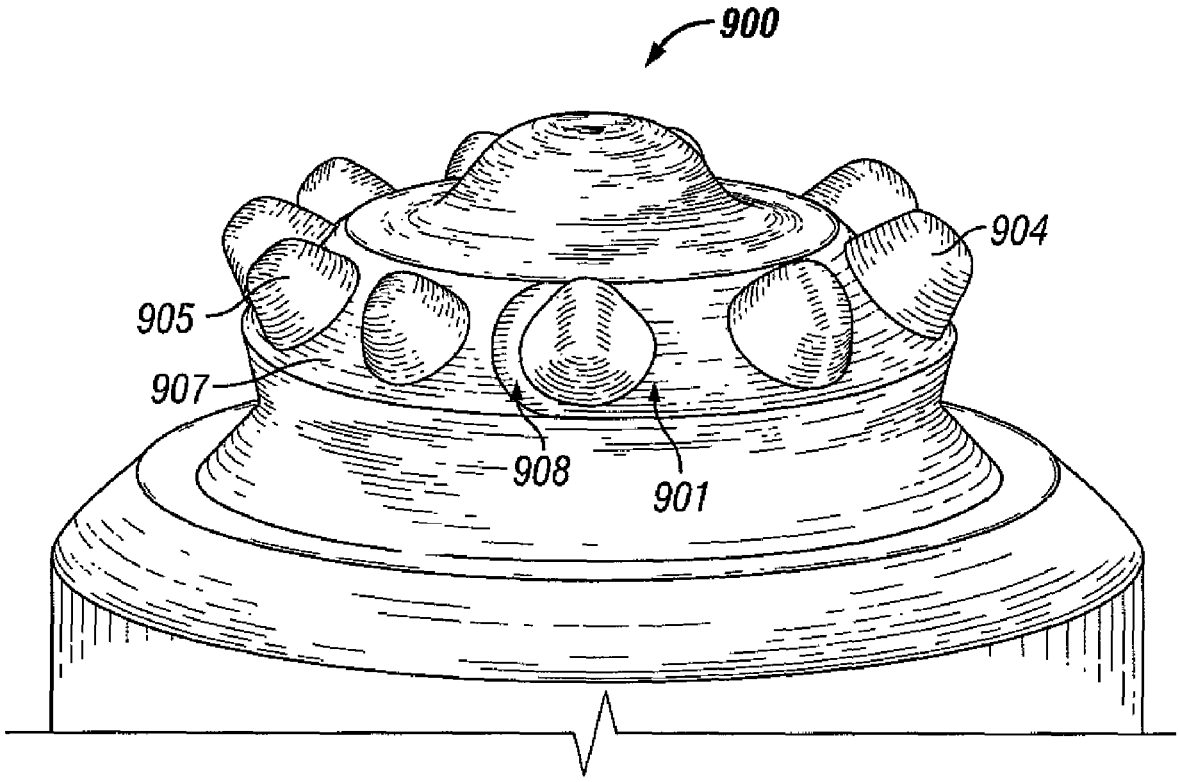
FIG. 19 shows a side view of a roller cone according to embodiments of the present disclosure.

Referring now to FIG. 19, a side view of a roller cone 900 according to embodiments of the present disclosure is shown. In this embodiment, roller cone 900 includes a plurality of cutting elements 904 and 905 disposed along a recessed portion 901 and a non-recessed portion 907 respectfully. Roller cone 900 also includes a transition zone 908 located between recessed portion 901 and non-recessed portion 907. As illustrated, transition zone 908 provides for a smooth concave transition between recessed portion 901 and non-recessed portion 907. Those or ordinary skill in the art will appreciate that a smooth transition 908 may be beneficial in reducing stresses to roller cone 900 or individual cutting elements 904 and 905. However, in alternate embodiments, transition zone 908 may include a convex portion, a substantially orthogonal portion, or an irregular portion. As such, the specific geometry of transition 908 may vary according to the requirements of a specific drill bit design.

Figure 20:
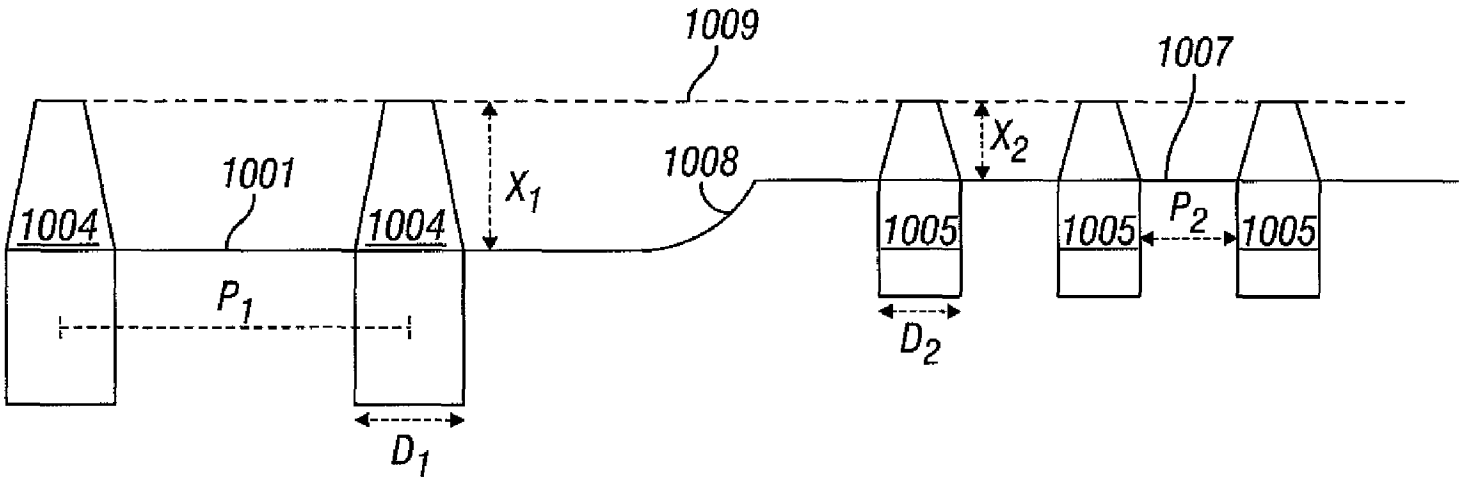
FIG. 20 shows a cross-sectional view of a roller cone according to embodiments of the present disclosure.

Referring to FIG. 20, a cross-sectional view of a roller cone in accordance with embodiments of the present disclosure is shown. In this embodiment, a roller cone surface (not numerically referenced) includes a recessed portion 1001 and a non-recessed portion 1007 that connect at a transition zone 1008. Recessed portion 1001 includes cutting elements 1004 in a first group, while non-recessed portion 1007 includes cutting elements 1005 in a second group. The pitch of the first group is defined by the distance between cutting elements 1004, indicated as distance $P_1$, while the pitch of the second group is defined by the distance between cutting elements 1005, indicated as distance $P_2$.

In this embodiment, cutting elements 1004 in the first group have a relatively larger diameter $D_1$ than cutting elements 1005 in the second group (having a diameter $D_2$). In addition to different diameters $D_1$ and $D_2$, cutting elements 1004 and 1005 may have different material properties, geometries, and material types. In this embodiment, cutting elements 1004 have an extension length $X_1$ while cutting elements 1005 have an extension length $X_2$. Cutting elements 1004, having a greater extension length $X_1$, thus expose more of cutting element 1004 to the formation while drilling. Increasing cutting element 1004 exposure to the formation may provide for an increased rate of penetration by allowing a more aggressive cutting geometry to be used. Additionally, greater extension length $X_1$ may increase the life of the drill bit by increasing the amount of carbide and/or steel that contacts formation, thereby decreasing, formation to cone contact that may result in bit failure. Moreover, in certain embodiments, greater extension length $X_1$ may also provide for a more beneficial hydraulic flow of drilling fluids, thereby increasing cuttings removal and cooling both the bit and the individual cutting elements.

Those of ordinary skill in the art will appreciate that cutting elements 1004 and 1005 may have different diameters $D_1$ and $D_2$, different extension lengths $X_1$ and $X_2$, and different pitches $P_1$ and $P_2$, but still contact formation along a same profile (illustrated as dashed line 1009). Contacting formation along the same profile 1009 may provide for increased rate of penetration, improved wear rates, and longer drill bit life, as described above.

Figure 21:
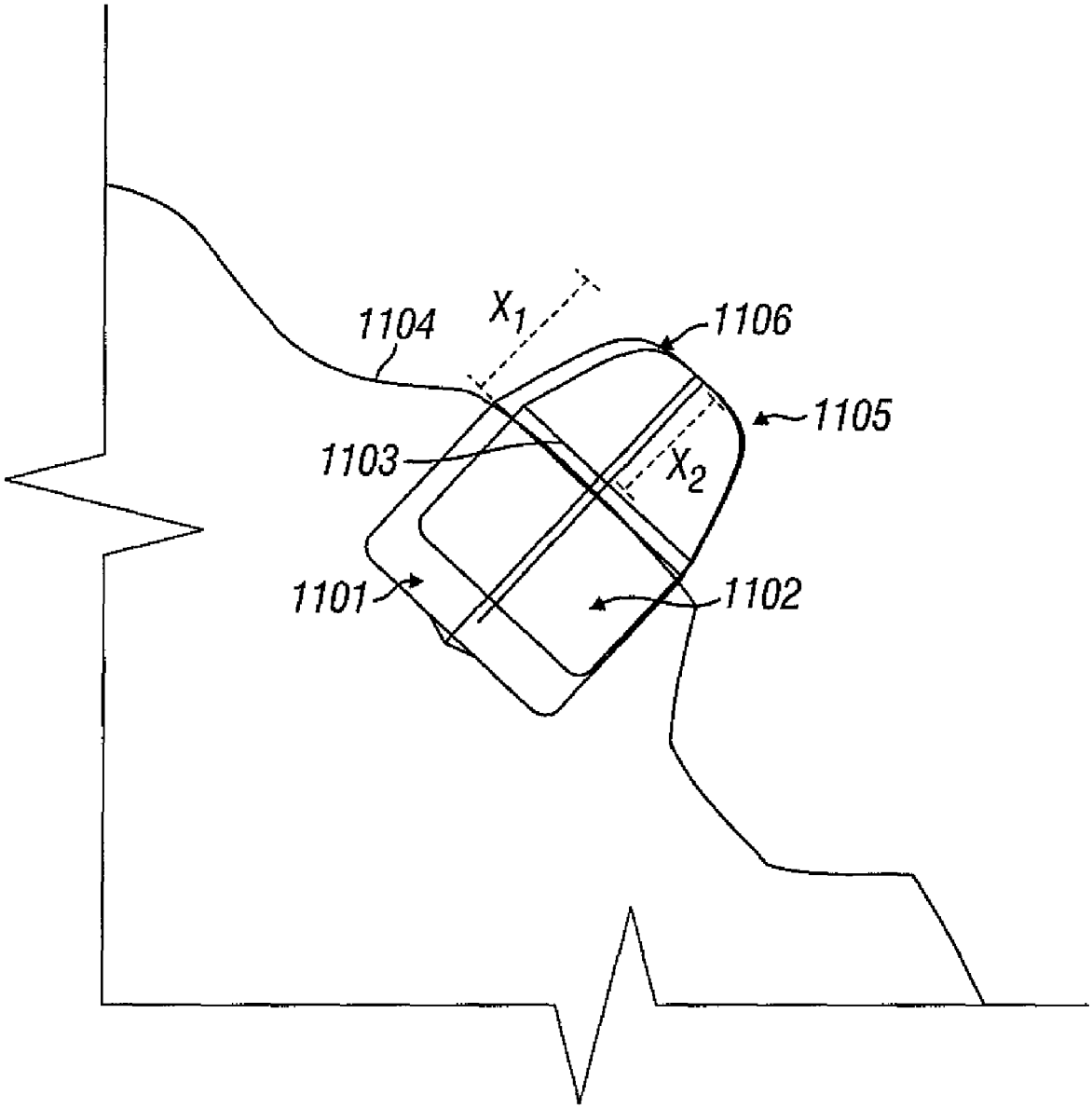
FIG. 21 shows a cross-sectional view of a row of cutting elements on a roller cone according to embodiments of the present disclosure.

Referring to FIG. 21, a cross-sectional view of a row of cutting elements on a roller cone according to embodiments of the present disclosure is shown. In this embodiment, a first cutting element 1101 is superimposed over a second cutting element 1102. As illustrated, first cutting element 1101 has a larger diameter than second cutting element 1102. Additionally, cutting element 1101 has a greater extension length $X_1$ than the extension length $X_2$ of cutting element 1102. As such, a larger portion of cutting element 1101 is capable of contacting formation during drilling.

Also in this embodiment, cutting element 1101 is illustrated as disposed in a recessed portion of the roller cone. Those of ordinary skill in the art will appreciate that a recess height (e.g., the difference between roller cone surface 1103 and roller cone surface 1104) may be varied to achieve optimum bit characteristics. A recess height may be increased to expose a greater volume of carbide to, for example, improve bit hydraulics, decrease cone wear, increase rate of penetration, etc. In other embodiments, a recess height may be decreased to, for example, provide an optimized dull grade, provide a desired cut profile, decrease cone wear, etc.

As described above, a recess height may also be varied to provide for an optimized cutting profile. As illustrated, outside edge (i.e., a side farthest from the apex of the cone) 1105 of both cutting elements 1101 and 1102 contact formation during drilling following a substantially similar profile. However, an inside edge (i.e., a side closed to the apex of the cone) 1106 of cutting elements 1101 and 1102 are not in alignment. Such design variations may allow for an optimized wear pattern of both cutting elements 1101 and 1102 by providing greater carbide volume along the outside edge 1105 (i.e., the area of greatest formation interface during drilling). Thus, those of ordinary skill in the art will appreciate that by either increasing an extension length of one or more of cutting elements 1101 and 1102, providing a recessed portion, or both increasing an extension length and providing a recessed portion, an optimized drill bit may be designed.

Figure 22:
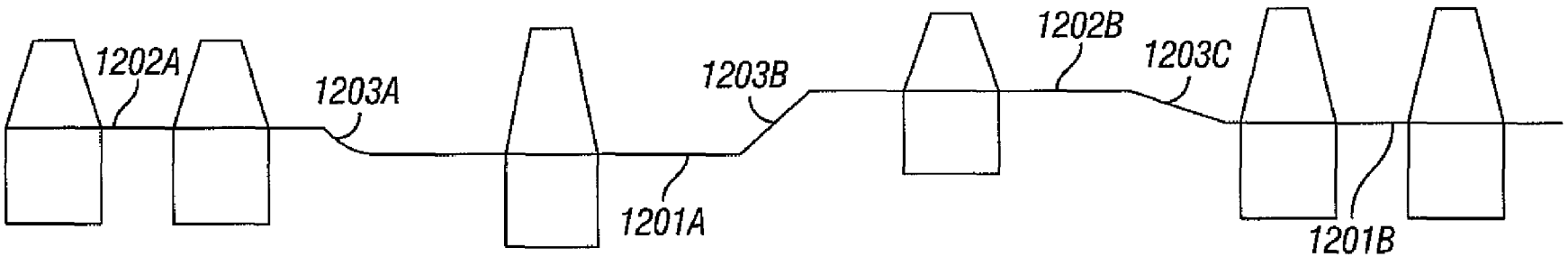
FIG. 22 shows a cross-sectional view of a roller cone according to embodiments of the present disclosure.

Referring to FIG. 22, a cross-section view of a roller cone row according to embodiments of the present disclosure is shown. In this embodiment, a roller cone having a plurality of recessed portions 1201 and non-recessed portions 1202 is shown. As illustrated, a first non-recessed portion **1202*a* may include two cutting elements having a first pitch, while a second non-recessed portion 1202*b* includes a single cutting element having a second pitch. Additionally, a first recessed portion 1201*a* may include a single cutting element having a first pitch, while a second recessed portion 1201*b* includes multiple cutting elements having a second pitch. As described above, multiple pitch differences, as well as a plurality of recessed portions 1201 and non-recessed portions 1202**, may be combined to provide an optimized roller cone.

Additionally, a plurality of transition zones 1203 may be defined to provide for an optimized transition between recessed portions 1201 and non-recessed portions 1202. In this embodiment, varied geometries of transition zone 1203 may be used to further optimize the roller cone. As illustrated, transition **1203*a* is a substantially smooth concave transition, while transition zone 1203*b* is substantially linear, and transition 1203*c* is a substantially smooth convex transition. Those of ordinary skill in the art will appreciate that transition zones 1203 with differing geometry, along with a plurality of recessed portions 1201 and non-recessed portions 1202**, may be combined to generate an optimized roller cone.

Advantageously, such cutting element arrangements may be provided to prevent cones from going tinder-gage as quickly. Further, such cutting element arrangements may provide improved cutting action of the bottom hole, corners, and gage of the hole.

Advantageously, in one or more embodiments, the present disclosure provides for a roller cone drill bit design, which enhances bottomhole coverage, while maintaining the cutting element structure.

While the present disclosure has been described with respect to a limited number of embodiments, those skilled in the art, having benefit of this disclosure, will appreciate that other embodiments can be devised which do not depart from the scope of the disclosure as described herein. Accordingly, the scope of the present disclosure should be limited only by the attached claims.

What is claimed is:

1. A method for designing a roller cone drill bit having a plurality of cutting elements arranged in a row, comprising:

defining a pitch pattern for the plurality of cutting elements such that a first group of adjacent cutting elements are arranged in a first pitch and a second group of adjacent cutting elements are arranged in a second pitch in the row, wherein the first group of adjacent cutting elements have a different extension length than the second group of adjacent cutting elements;

evaluating the pitch pattern of the plurality of cutting elements in the row; and modifying at least one of the plurality of cutting elements, based on the evaluating of the pitch pattern of the plurality of cutting elements.

2. The method of claim 1, wherein the modifying comprises changing at least one of a geometry, a material type, and a material property of the at least one of the plurality of cutting elements.

3. The method of claim 1, wherein the evaluating comprises simulating the roller cone drill bit.

4. The method of claim 1, further comprising:

manufacturing the roller cone drill bit.

5. The method of claim 1, wherein the first group are arranged on a cone having a recessed portion thereon.

6. The method of claim 1, wherein a centerline of at least two of the cuttings elements are offset.

7. The method of claim 1, further comprising:

modifying the extension length of at least one cutting elements based on an expected dull condition of the at least one cutting element.

8. A roller cone drill bit, comprising:

at least one roller cone; and a plurality of cutting elements arranged in a row on the at least one roller cone, wherein a first group of adjacent cutting elements are arranged in a first pitch in the row and a second group of adjacent cutting elements are arranged in a second pitch in the row, wherein the first pitch and the second pitch are different; and wherein the first group of adjacent cutting elements have a different extension length than the second group of adjacent cutting elements.

9. The roller cone drill bit according to claim 8, wherein the row comprises a drive row.

10. The roller cone drill bit according to claim 8, wherein the row comprises a gage row.

11. The roller cone drill bit according to claim 8, wherein the first group is disposed on a recessed portion of the at least one roller cone.

12. The roller cone drill bit of claim 8, wherein at least one of the cutting elements in the first group of adjacent cutting elements have at least one of a different geometry, material type, and material property from at least one of the cutting elements in the second group of adjacent cutting elements.

13. The roller cone drill bit of claim 8, wherein a centerline of at least two of the cuttings elements are offset.

14. The roller cone drill bit of claim 8, wherein the extension length of at least one of the cutting elements in the first group is modified based on an expected dull condition of the at least one cutting element.

15. A roller cone drill bit, comprising:

at least one roller cone; and a plurality of cutting elements arranged in a row on the at least one roller cone, wherein a first group of adjacent cutting elements is arranged in a first pitch in the row and a second group of adjacent cutting elements is arranged in a second pitch in the row, wherein the first pitch and the second pitch are different, and wherein the first group is disposed on the at least one roller cone on a recessed portion.

16. The roller cone drill bit according to claim 15, wherein the first group of adjacent cutting elements have a different extension length than the second group of adjacent cutting elements.

17. The roller cone drill bit of claim 15, wherein at least one of the cutting elements in the first group of adjacent cutting elements have at least one of a different geometry, material type, and material property from at least one of the cutting elements in the second group of adjacent cutting elements.

18. The roller cone drill bit of claim 15, wherein a centerline of at least two of the cuttings elements are offset.

19. The roller cone drill bit of claim 15, wherein the recessed portion is modified, based on an expected dull condition of the at least one cutting element.

20. A method for designing a roller cone drill bit having a plurality of cutting elements arranged in a row, comprising:

defining a pitch pattern for the plurality of cutting elements such that a first group of adjacent cutting elements are arranged in a first pitch and a second group of adjacent cutting elements are arranged in a second pitch in the row, wherein the first group of adjacent cutting elements are disposed on a recessed portion;

evaluating the pitch pattern of the plurality of cutting elements in the row; and modifying at least one of the plurality of cutting elements, based on the evaluating of the pitch pattern of the plurality of cutting elements.

21. The method of claim 20, wherein the modifying comprises changing at least one of a geometry, a material type, and a material property of the at least one of the plurality of cutting elements.

22. The method of claim 20, wherein the evaluating comprises simulating the roller cone drill bit.

23. The roller cone drill bit of claim 20, wherein a centerline of at least two of the cuttings elements are offset.

24. The method of claim 20, further comprising:

manufacturing the roller cone drill bit.

* * * * *